US005571662A

United States Patent [19]

Mihara et al.

[11] Patent Number: 5,571,662

[45] Date of Patent: Nov. 5, 1996

[54] SILVER HALIDE PHOTOGRAPHIC MATERIAL

[75] Inventors: Yuji Mihara; Tadashi Ikeda; Yoshio Inagaki; Takashi Kato, all of Kanagawa, Japan

[73] Assignee: Fuji Photo Film Co., Ltd., Kanagawa, Japan

[21] Appl. No.: 419,756

[22] Filed: Apr. 10, 1995

Related U.S. Application Data

[63] Continuation of Ser. No. 167,220, Dec. 16, 1993, abandoned, which is a continuation of Ser. No. 878,453, May 5, 1992, abandoned.

[30] Foreign Application Priority Data

May 15, 1991 [JP] Japan ..... 3-138613

[51] Int. Cl.[6] ..... G03C 1/20; G03C 1/38

[52] U.S. Cl. ..... 430/567; 430/584; 430/638; 430/944

[58] Field of Search ..... 430/584, 944, 430/567, 638

[56] References Cited

U.S. PATENT DOCUMENTS 4,619,892 10/1986 Simpson et al. ..... 430/505

5,057,405 10/1991 Shiba et al. ..... 430/944

FOREIGN PATENT DOCUMENTS 313021 4/1989 European Pat. Off. ..... 430/584

*Primary Examiner*—Lee C. Wright

*Attorney, Agent, or Firm*—Sughrue, Mion, Zinn, Macpeak & Seas

[57] ABSTRACT

A silver halide photographic material is disclosed, comprising a support having thereon at least one silver halide photographic emulsion layer, wherein the silver halide emulsion layer has been spectral-sensitized with a spectral-sensitizer to have a sensitized peak in a wavelength range longer than 730 nm; and light absorption due to the silver halide emulsion containing the spectral sensitizer satisfies the following equation (1):

$$\text{Abs (peak wavelength)}/\text{Abs (peak wavelength}-100\text{ nm)}>5 \quad (1);$$

and a method for processing the above silver halide photographic material.

The material has high sensitivity only to semiconductor laser rays and has low sensitivity to any other rays.

6 Claims, No Drawings

SILVER HALIDE PHOTOGRAPHIC MATERIAL

This is a Continuation of application Ser. No. 08/167,220 filed Dec. 16, 1993 now abandoned, which is a continuation of application Ser. No. 07/878,453 filed May 5, 1992, now abandoned.

FIELD OF THE INVENTION

The present invention relates to a silver halide photographic material spectral-sensitized to infrared rays and, in particular, to a J-band sensitized silver halide photographic material which has been strongly sensitized only to selected rays in an infrared spectral range but which has a low sensitivity to other rays in other wave-length ranges.

BACKGROUND OF THE INVENTION

One means of exposing photographic materials is a known image forming method using a so-called scanner system. An original is scanned and a silver halide photographic material is exposed on the basis of the resulting image signal so as to form a negative image or positive image corresponding to the image of the original thereon.

There are various practical recording devices which may be used in such a scanner system image forming method. The recording light sources for scanner system recording devices include a glow lamp, a xenon lamp, a mercury lamp, a tungsten lamp and a light emitting diode. However, all these light sources have the drawbacks that the output is weak and their life is short. To compensate for these drawbacks, there are known scanners which use coherent laser rays, such as a Ne—He laser, an argon laser or a He—Cd laser, as the light source for the scanning system. The coherent laser rays may yield a high output, but they have other drawbacks in that they need large-sized, high-priced devices and modulators. In addition, since visible rays are used, the safelight for the photographic materials is limited and the handlability of the devices is poor.

In contrast, devices for semiconductor lasers are small-sized and low-priced and may be easily modulated. In addition, semiconductor lasers have a longer life than the above-mentioned lasers. Moreover, since they emit infrared rays, a light safelight may be used in handling infrared-sensitive photographic materials. Therefore, semiconductor lasers are advantageous with respect to handlability and operability. Despite these advantages, since there are unknown excellent photographic materials having high infrared sensitivity and good storage stability, the excellent characteristics of these semiconductor lasers could not be utilized satisfactorily.

In one known technology for producing photographic materials, cyanine dyes of a certain kind are added to silver halide photographic materials so as to extend their light-sensitive range on the side of a longer wavelength. This is a so-called spectral sensitizing technology. It is also known that the spectral sensitizing technology may apply not only to rays of a visible range, but also to those of an infrared range. For infrared sensitization, sensitizing dyes capable of absorbing infrared rays are used, which are described in, for example, Mees, *The Theory of the Photographic Process*, 3rd Ed. (published by MacMillan, 1966), pages 198 to 201. In that case, the photographic materials desirably have a high sensitivity to infrared rays and a small variation in sensitivity, even during storage of the emulsions. For this purpose, various sensitizing dyes have heretofore been developed.

For instance, many sensitizing dyes are described in U.S. Pat. Nos. 2,095,854, 2,095,856, 2,955,939, 3,482,978, 3,552,974, 3,573,921 and 3,582,344. However, even though these sensitizing dyes are used, the sensitivity and storage stability of the photographic materials to which they are added could not be said to be fully sufficient.

On the other hand, it is also known that addition of a second specifically selected organic compound of a certain kind to the photographic materials, in addition to spectral sensitizing dyes, noticeably increases the spectral sensitivity of the materials; and the effect to be attained by the addition is known as a supersensitizing effect.

For supersensitization in the infrared range, JP-A-59-191032, JP-A-59-192242 and JP-A-60-80841 (the term "JP-A" as used herein means an "unexamined published Japanese patent application") describe the combination of infrared sensitizing dyes (tricarbocyanine dyes, 4-quinolinedicarbocyanine dyes) and cyclic onium salt compounds or heterocyclic compounds of certain kinds. However, the techniques as described in these publications are still insufficient for obtaining a sufficiently high sensitivity.

Since laser rays, including semiconductor laser rays, each have a determined wavelength, the photographic materials to be exposed to such laser rays typically will be selected so as to be only strongly sensitized by exposure to a particular ray having the same wavelength as the ray emitted by a laser. That is, in typical usages, the photographic materials are preferred which have a low sensitivity to any other rays in a wavelength range different from the wavelength of the ray to be emitted by a laser in view of the safelight safety concerns for the photographic materials. The technology of sensitizing photographic materials to only rays in a particular wave-length range is known as J-band sensitization in the field of spectral sensitization of silver halide photographic materials.

However, while many examples of J-band sensitization are known to visible rays, those known to infrared rays are scarce. Examples of the latter are mentioned in A. H. Henry, *P.S.E.* 18 (3), pp. 323–335 (1974), and H. Kampfer, *ICPS Reports*, pp. 366–369 (1986).

In an infrared-sensitized system having a sensitized peak in a wavelength region longer than 730 nm, when the amount of the dye to be added thereto is increased, the photographic material is strongly desensitized (e.g., see U.S. Pat. No. 4,011,083). Therefore, the dye-coated percentage of the surfaces of silver halide grains in the photographic material is generally restricted to approximately from 10 to 20%, but addition of the dye in such a limited amount could barely yield J-band sensitization.

Also, various organic compounds such as stabilizers are typically added to silver halide photographic materials, and various organic solvents such as methanol or ethanol are generally used as carriers for addition of such organic compounds. Where the organic solvent for this purpose is added in such a degree that it would not cause deterioration of the gelatin in the photographic material, there would occur no disadvantageous problems. However, where the photographic material is to be sensitized for J-band sensitization to rays being in a wavelength range longer than 730 nm, the presence of some organic solvents would cause noticeable hindrance and interfere with formation of J-band sensitization. Therefore, even though a photographic material is desired to be sensitized to rays being in a wavelength longer than 730 nm, J-band sensitization could not be attained if a conventional amount of a conventional dye is used along with a conventional amount of a conventional solvent.

Although the above-mentioned literature refers to J-band sensitization, the authors thereof did not have sufficient intention and knowledge of laser exposure and safe light handling of photographic materials, and, as a result, the authors' recognition of the importance of lowering the sensitivity of photographic materials to unnecessary rays was unsatisfactory. Under such situation, even though they succeeded in J-band sensitization, they could only obtain materials which were inadequate for practical use. In view of this situation, it has been desired in this field to develop a sensitization method capable of attaining J-band sensitization of photographic materials which are suitable for exposure to semiconductor laser rays while decreasing the undesired sensitivity of the photographic materials to other rays of different wavelength.

On the other hand, the speed of processing photographic materials with an automatic developing machine is being demanded to be increased more and more in current practice. With such increasing speed of processing, a sufficient time for decoloring the dye in the photographic materials being processed cannot be ensured so that the processed materials often have a problem caused by the residual color (i.e., remaining color) of dyes therein. Therefore, a sensitizing system causing little residual color in the processed photographic materials is desired.

SUMMARY OF THE INVENTION

One object of the present invention is to provide a silver halide photographic material having a high sensitivity to infrared rays and, in particular, to provide a J-band sensitized silver halide photographic material having a high sensitivity to semiconductor laser rays but having a low sensitivity to any wavelengths of rays other than semiconductor laser rays.

Another object of the present invention is to provide a silver halide color photographic material having a high sensitivity to infrared rays and having little residual color even when processed by rapid processing.

The above and other objects and advantages of the present invention have been attained by a silver halide photographic material comprising a support having thereon at least one silver halide photographic emulsion layer, wherein the silver halide emulsion layer has been spectral-sensitized with a spectral sensitizer to have a sensitized peak in a wavelength range longer than 730 nm, and light absorption due to the silver halide emulsion layer containing said spectral-sensitizer satisfies the following equation (1):

$$\text{Abs (peak wavelength)}/\text{Abs (peak wavelength}-100\text{ nm)}>5 \quad (1);$$

and a method for processing the above silver halide photographic material.

DETAILED DESCRIPTION OF THE INVENTION

The objects of the present invention can be attained when the silver halide emulsion has a sensitized peak in a wavelength range longer than 730 nm and satisfies the above-mentioned equation (1). However, if a sensitizing dye is merely added in arbitrary amounts to the silver halide emulsion, it can be difficult to sensitize the emulsion to satisfy equation (1). That is, satisfaction of equation (1) generally requires that the dye-coated percentage of the surfaces of the silver halide grains is provided as 50% or more, preferably 60% or more, more preferably 70% or more. Use of organic solvents, such as methanol, ethanol, propanol or methyl cellosolve, to be added to the silver halide emulsion is desired to be decreased. For instance, the amount of such organic solvents to be added to the silver halide emulsion is preferably 180 ml or less, more preferably 120 ml or less, per kg of the emulsion, whereby equation (1) can be satisfied. If the amount of such organic solvent to be added is too much, the equation (1), Abs (peak wavelength)/Abs (peak wavelength−100 nm)>5, is not satisfied.

The determination on whether or not the emulsion to which a sensitizing dye has been added would satisfy the above-mentioned equation (1) can be performed by measuring a film coated with the emulsion layer with an integrating sphere-combined spectrophotometer (for example, Spectrophotometer U-3410 Model, manufactured by Hitachi Ltd.). The wavelength range for the measurement is from a wavelength longer than the peak wavelength in an infrared range to a wavelength shorter by 100 nm or more than the peak wavelength; and the absorbance (Abs) at the peak wavelength and the absorbance (Abs) at the wavelength shorter than the peak wavelength by 100 nm are obtained, whereupon the ratio of the two is calculated in accordance with the above-mentioned equation (1).

Sensitizing dyes usable as a spectral-sensitizer in the present invention are not particularly limited as long as they give rise to satisfaction of the above-mentioned equation (1). Compounds represented by formulae (I) and (II) are especially useful:

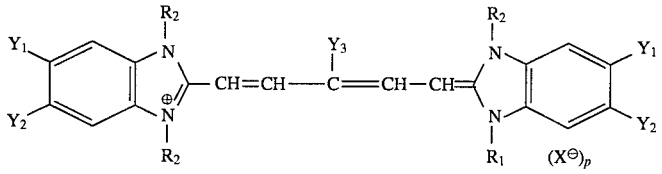

(I)

wherein $R_1$ and $R_2$ each represents an alkyl group having from 1 to 8 carbon atoms;

$Y_1$ and $Y_2$ are bonded to each other to form an atomic group for completing a benzene nucleus, each of $Y_1$ and $Y_2$ independently represents a hydrogen atom, a halogen atom, a cyano group or a perfluoroalkyl group;

$Y_3$ represents a hydrogen atom, an alkyl group having from 1 to 4 carbon atoms, a benzyl group or a phenyl group;

X represents an anion;

p represents a number to be determined so that the number of cation charges and the number of anion charges in the formula are the same; and X may be bonded to $R_1$ or $R_2$ to form an internal salt.

Compounds represented by formula (I) will be explained in detail hereunder.

The alkyl group represented by $R_1$ or $R_2$ may be linear, branched or cyclic, and it may be substituted. As substituents in the substituted form of the alkyl group (preferably having 1 to 4 carbon atoms), there are mentioned, for example, a halogen atom, an alkoxy group (preferably having 1 to 4 carbon atoms), an alkylthio group (preferably having 1 to 4 carbon atoms), a sulfonic acid group or its salt, a carboxyl group or its salt.

$R_1$ is preferably an alkyl group having from 1 to 4 carbon atoms, more preferably an unsubstituted alkyl group or an alkyl group substituted by a sulfonic acid group or its salt.

$R_2$ is preferably an alkyl group having from 1 to 4 carbon atoms, more preferably an unsubstituted alkyl group or an alkyl group substituted by a halogen atom (particularly preferably, a fluorine atom) or an alkoxy group having from 1 to 4 carbon atoms.

$Y_1$ and $Y_2$ each is preferably a hydrogen atom, a chlorine atom, a cyano group, or a trifluoromethyl group. More preferably, $Y_1$ is a chlorine atom, and $Y_2$ is a chlorine atom, a cyano group, or a trifluoromethyl group.

$Y_3$ is preferably a hydrogen atom, a methyl group, an ethyl group or a butyl group, more preferably a hydrogen atom.

The anion represented by X is preferably a halide ion, a sulfonate ion or a carboxylate ion, particularly preferably an iodide ion, a paratoluenesulfonate ion or an acetate ion, or a sulfonate ion as substituting on $R_1$. In the last-mentioned case, p is 1.

The preferred compound represented by formula (I) which is used as a spectral-sensitizer in the present invention is a dicarboimidacyanine dye.

Specific examples of dicarboimidacyanine dyes represented by formula (I) usable in the present invention will be mentioned below, which, however, are not limitative.

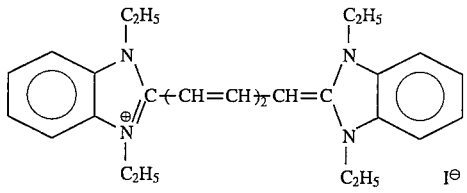

I-1

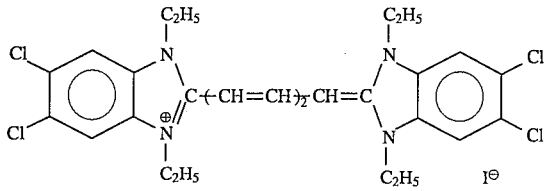

I-2

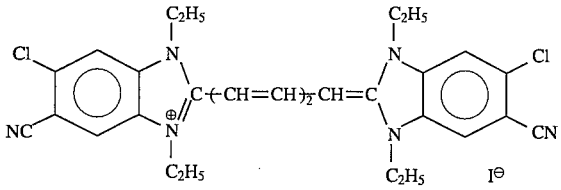

I-3

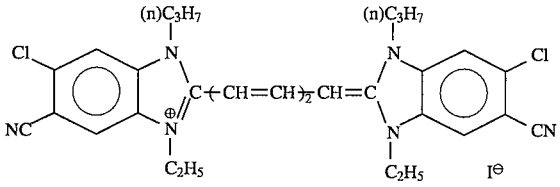

I-4

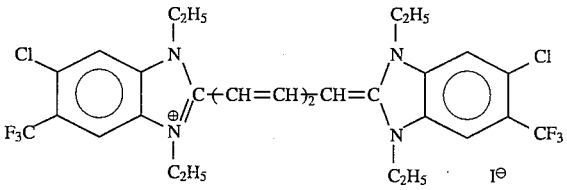

I-5

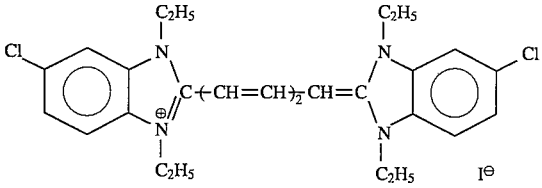

I-6

-continued
I-7
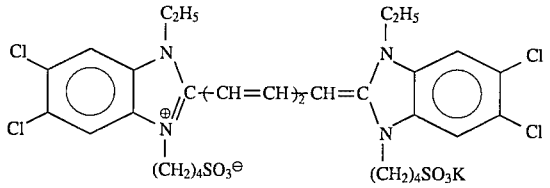
I-8
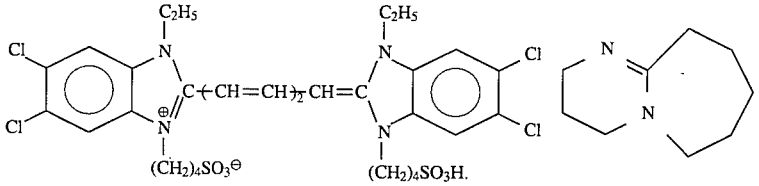
I-9
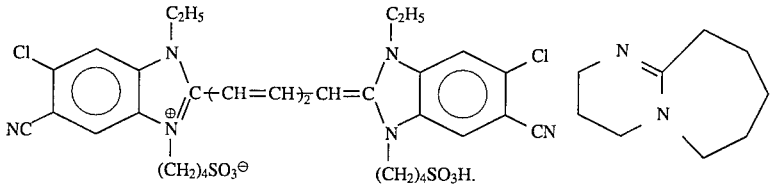
I-10
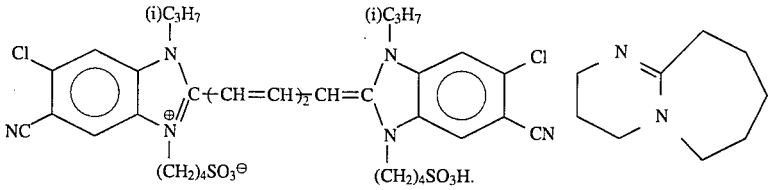
I-11
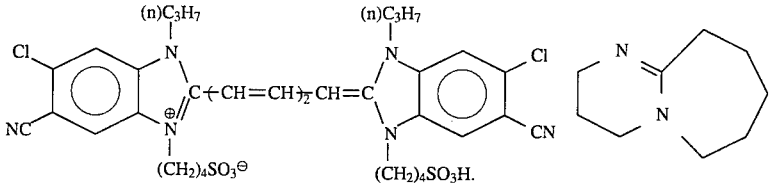
I-12
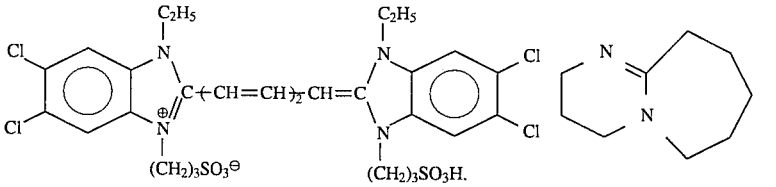
I-13
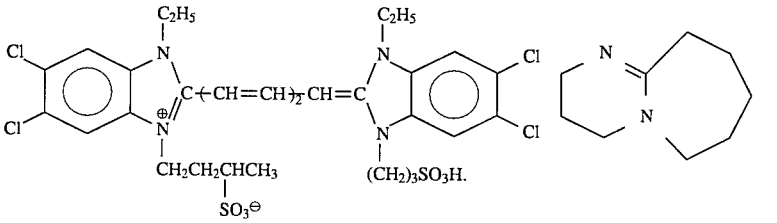
I-14
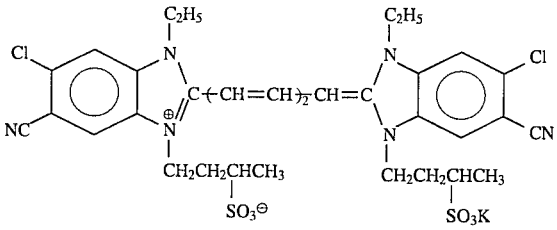

-continued
I-15
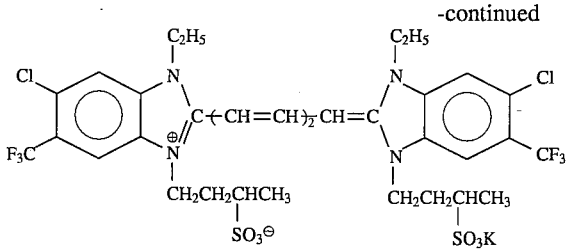
I-16
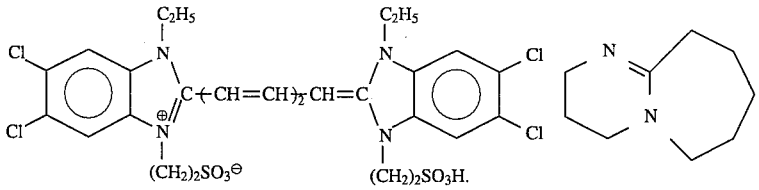
I-17
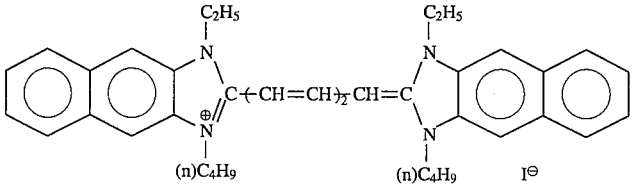
I-18
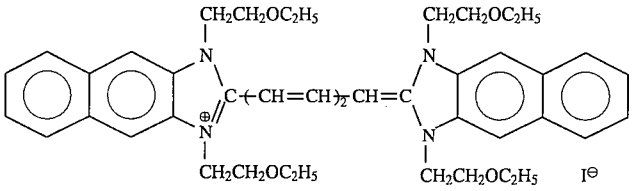
I-19
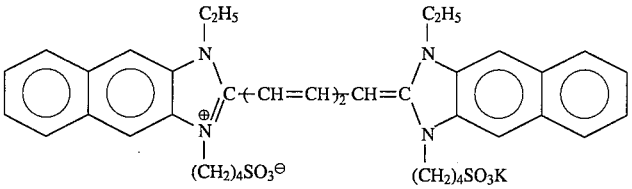
I-20
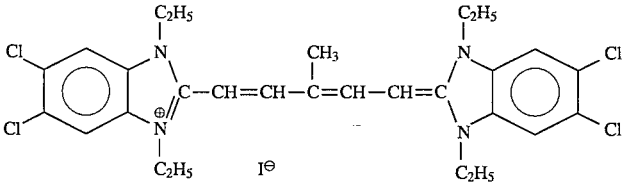
I-21
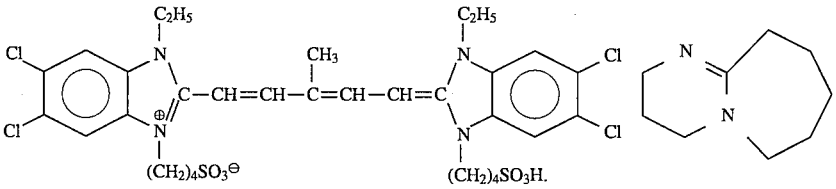
I-22
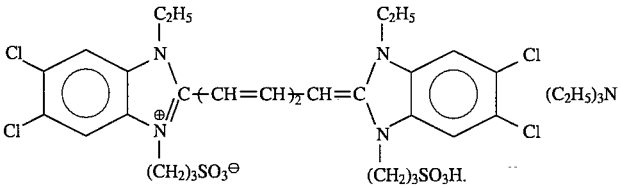

-continued

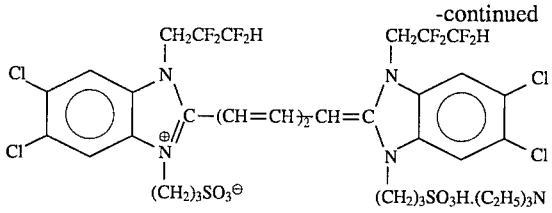

I-23

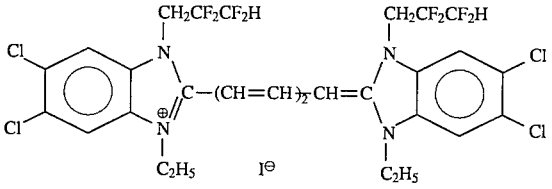

I-24

Among these, Dyes I-2, I-3, I-5, I-7, I-9, 1-12, I-16 and I-20 are preferred.

The compounds represented by formula (I) is used in an amount of preferably from 100 mg to 2 g and more preferably from 200 mg to 1.5 g, per mol of silver.

Formula (II) is described as follows:

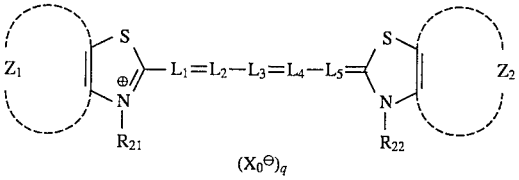

(II)

wherein $R_{21}$ and $R_{22}$ each represents an alkyl group having from 1 to 8 carbon atoms;

$Z_1$ and $Z_2$ each represents an atomic group necessary for completing a benzene ring or naphthalene ring;

$L_1$, $L_2$, $L_3$, $L_4$ and $L_5$ each represents a substituted or unsubstituted methine group;

any of $L_2$ and $L_4$, $L_1$ and $R_{21}$, and $L_5$ and $R_{22}$ may be bonded to each other via a substituent on $L_2$ or $L_4$, $L_1$ and $L_5$, respectively, to form a ring;

$X_0^-$ represents an anion;

q represents a number to be determined so that the number of cation charges and the number of anion charges in the formula are the same; and $X_0^-$ may be bonded to $R_{21}$ or $R_{22}$ to form an internal salt.

Compounds represented by formula (II) will be explained below in detail.

The alkyl group represented by $R_{21}$ or $R_{22}$ may be linear, branched or cyclic, and it may be substituted. As substituents of the substituted alkyl group (preferably having 1 to 4 carbon atoms), there are mentioned, for example, a halogen atom, an alkoxy group (preferably having 1 to 4 carbon atoms), an alkylthio group (preferably having 1 to 4 carbon atoms), a sulfonic acid group or its salt, a carboxyl group or its salt.

$R_{21}$ is preferably an alkyl group having from 1 to 4 carbon atoms, and more preferably an unsubstituted alkyl group or an alkyl group substituted by a sulfonic acid group or its salt.

The benzene ring or naphthalene ring to be completed by $Z_1$ or $Z_2$ may have substituent(s). As preferred examples of the substituents, there are mentioned a fluorine atom, a chlorine atom, an alkyl group having from 1 to 4 carbon atoms (e.g., methyl, ethyl, trifluoromethyl, methylthiomethyl), an alkoxy group having from 1 to 4 carbon atoms (e.g., methoxy, ethoxy, 2-methoxyethyl, di-oxymethylene-1,3-diyl), and an alkylthio group having from 1 to 4 carbon atoms (e.g., methylthio, carboxymethylthio, 2-methylthioethylthio).

The methine group represented by any one of $L_1$ to $L_5$ may have substituent(s). As preferred examples of the substituents, there are mentioned an alkyl group having from 1 to 8 carbon atoms, a substituted or unsubstituted phenyl group having from 6 to 8 carbon atoms, and an alkoxy group having from 1 to 8 carbon atoms. As noted above, any of $L_2$ and $L_4$, $L_1$ and $R_{21}$, and $L_5$ and $R_{22}$ may be bonded to each other via the substituent on $L_2$ or $L_4$, $L_1$ and $L_5$, respectively, to form a ring. The ring thus-formed is preferably a 5-membered or 6-membered ring. More preferably, $L_2$ and $L_4$ are bonded to each other via $—CH_2C(G_1)(G_2)CH_2—$ to form a 6-membered ring, in which $G_1$ and $G_2$ each is a hydrogen atom, an alkyl group having from 1 to 6 carbon atoms, or a phenyl group.

Preferred examples of the anion represented by $X_0$ are a halide ion, a sulfonate ion and a carboxylate ion. More preferred are an iodide ion, a paratoluenesulfonate ion and an acetate ion, as well as a sulfonate ion as substituting on $R_{21}$ or $R_{22}$. In the latter-mentioned case q is 1.

Specific examples of compounds of formula (II) to be used in the present invention are mentioned below, which, however, are not limitative.

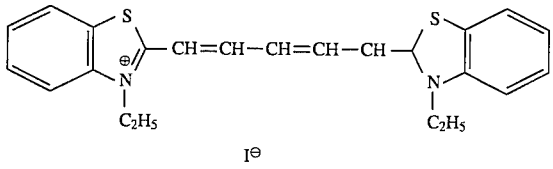

II-1

-continued
II-2
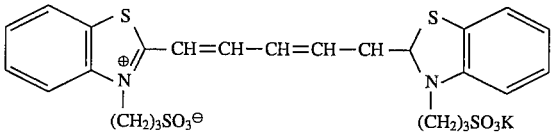
II-3
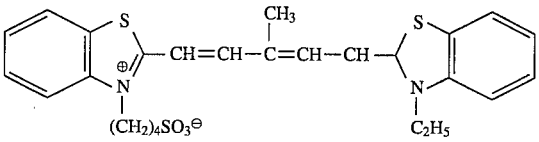
II-4
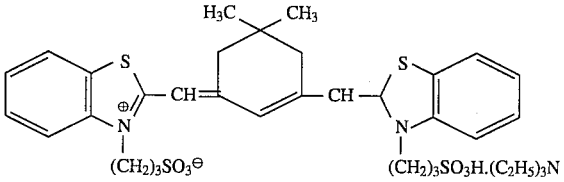
II-5
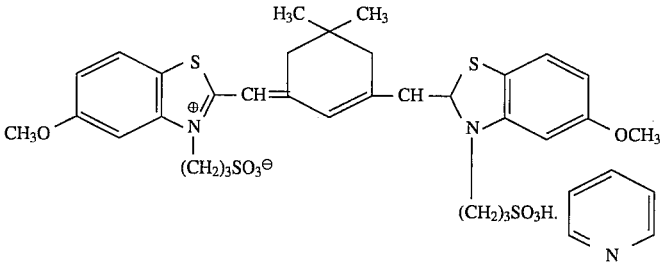
II-6
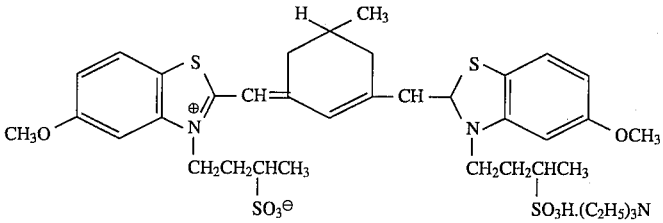
II-7
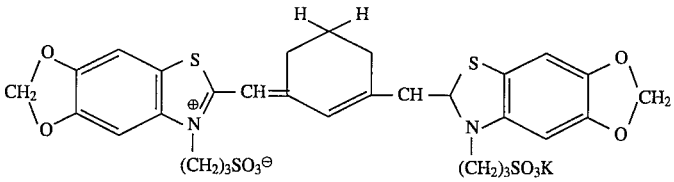
II-8
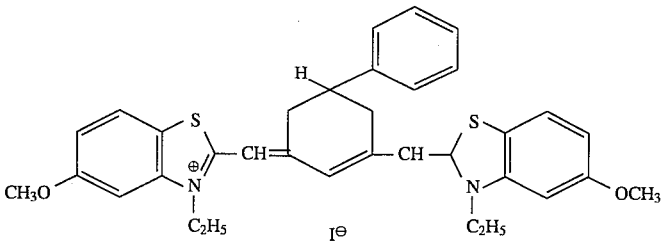
II-9
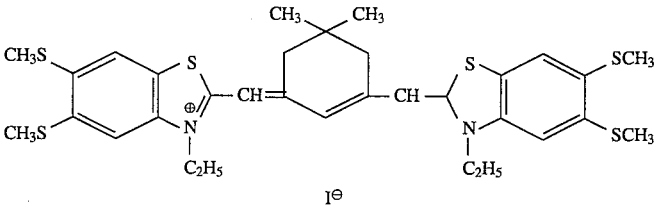

-continued

II-10

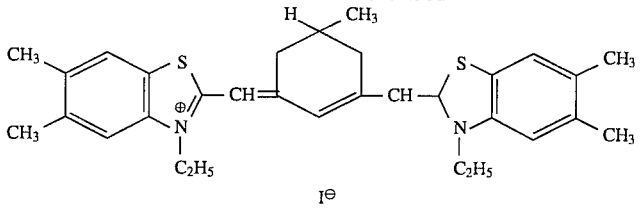

II-11

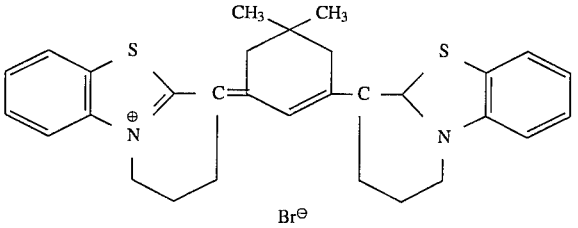

II-12

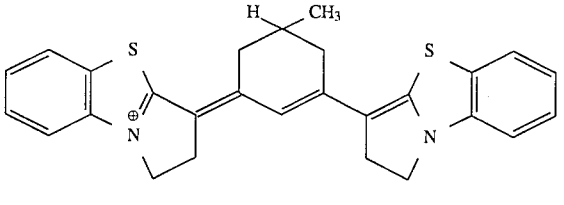

II-13

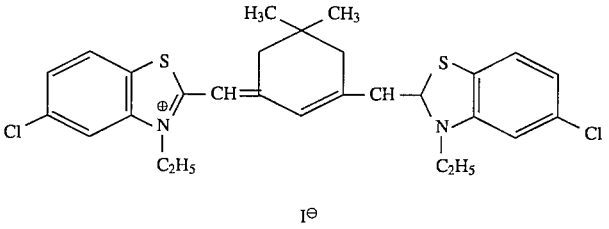

II-14

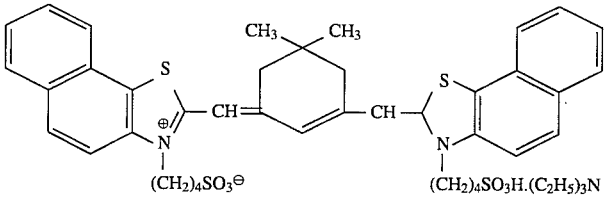

II-15

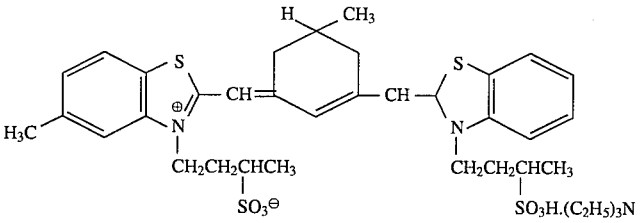

Among these, Compounds II-4, II-5, II-6, II-8, II-10, II-14 and II-15 are preferred.

The silver halides for use in the present invention may be silver chloride, silver bromide, silver iodide, silver chlorobromide, silver chloroiodide, silver iodobromide or silver chloroiodobromide. Of them, advantageously used are silver chlorobromide or silver chloroiodobromide having a chloride content of 50 mol % or more and silver chloride.

To react soluble silver salts and soluble halides for producing silver halides for use in the present invention, a single jet method, a double jet method or combination of them may be employed.

A so-called reversed mixing method of forming silver halide grains in the presence of excess silver ions may also be employed. One suitable system of a double jet method is a so-called controlled double jet method where the pAg value in the liquid phase for forming silver halide grains is kept constant. In accordance with the method, an emulsion of silver halide grains each having a regular crystalline form and having almost uniform grain sizes can be produced.

To form silver halide grains for use in the present invention, one may use a silver halide solvent for controlling the growth of the grains. Such solvents include, for example, ammonia, potassium rhodanide, ammonium rhodanide, thioether compounds (such as those described in U.S. Pat. Nos.

3,271,157, 3,574,628, 3,704,130, 4,297,439, 4,276,374), thione compounds (such as those described in JP-A-53-144319, JP-A-53-82408, JP-A-55-77737), and amine compounds (such as those described in JP-A-54-100717).

The silver halide grains for use in the present invention preferably have a mean grain size of 1.0 μm or less, especially preferably 0.7 μm or less.

In the present invention, water-soluble rhodium salts, such as rhodium chloride, rhodium trichloride or rhodium ammonium chloride, are preferably used. Complexes of these salts may also be used. Such rhodium salts may be added at any time before the finish of the first ripening in the preparation of the emulsions, and they are desirably added during the formation of the grains. The amount to be added is preferably from $1\times10^{-8}$ mol to $1\times10^{-6}$ mol and more preferably from $4\times10^{-8}$ to $1\times10^{-6}$ mol, per mol of silver.

In addition, water-soluble iridium salts such as $Na_3IrCl_6$ or $Na_2IrCl_6$ may be used. The time for adding water-soluble iridium salts is desirably before the first ripening in the preparation of the emulsions; and especially preferably they are added during the formation of the grains. The amount to be added is from $1\times10^{-8}$ mol to $1\times10^{-5}$ mol and more preferably from $4\times10^{-8}$ to $1\times10^{-6}$ mol, per mol of silver.

Various gold salts may be used as a gold sensitizer for sensitizing emulsions of the present invention. For instance, they include potassium chloroaurate, potassium auric thiocyanate, potassium chloroaurate and auric trichloride. Examples of suitable gold sensitizers are described in U.S. Pat. Nos. 2,399,083 and 2,642,361.

The sulfur sensitizers to be used for sensitizing emulsions of the present invention include sulfur compounds in gelatin as well as other various sulfur compounds such as thiosulfates, thioureas, thiazoles and rhodanines. Examples of suitable sulfur sensitizers are described in U.S. Pat. Nos. 1,574,944, 2,278,947, 2,410,689, 2,728,668, 3,501,313 and 3,656,955. Preferred sulfur compounds are thiosulfates and thiourea compounds.

The amount of sulfur sensitizers and gold sensitizers to be added is preferably from $1\times10^{-2}$ to $1\times10^{-7}$ mol, more preferably from $1\times10^{-3}$ mol to $5\times10^{-6}$ mol, per mol of silver.

The molar ratio of sulfur sensitizer to gold sensitizer to be used may be from 1/3 to 3/1, preferably from 1/2 to 2/1.

In the present invention, a reduction sensitizing method may also be employed.

Suitable reducing sensitizers include stannous salts, amines, formamidinesulfinic acids and silane compounds.

The temperature for the chemical sensitization of emulsions of the present invention may be selected from the range of from 30° C. to 90° C. The pH value in the chemical sensitization may be from 4.5 to 8.5, preferably from 5.0 to 7.0. The time for chemical sensitization could be defined as varying in accordance with the temperature in the system, the amount of chemical sensitizer used and the pH value in the system. However, it may be selected from the range of from several minutes to several hours and, generally, it is from 10 minutes to 200 minutes.

Where silver halide emulsions are infrared-spectral sensitized, the stability of the emulsions is often worsened. In order to prevent this, the addition of water-soluble bromides to the emulsions is effective. Suitable water-soluble bromides include various compounds capable of being dissociated into bromide ions in water. For instance, they include bromide salts such as ammonium, potassium, sodium or lithium bromide. In addition, suitable organic bromides such as tetraethyl ammonium bromide and ethylpyridinium bromide may be used. However, of these bromide salts, cadmium bromide and zinc bromide are not desired since they are harmful to human bodies if too much of them is absorbed. Therefore, the above-mentioned harmless water-soluble bromides are preferred.

The amount of water-soluble bromides added to the emulsions may be such that would substantially increase the sensitivity of the emulsion and/or would substantially inhibit time-dependent fluctuation of the sensitivity thereof. The amount of water-soluble bromides added to the emulsions may widely vary, and especially preferred results can be obtained when they are added in an amount of from 0.0003 to 0.01 mol per mol of silver. More preferred results can be attained when they are added in an amount of from 0.0005 to 0.005 mol per mol of silver. Where the anion of the sensitizing dye of formula (I) is bromine or bromide, the above-defined amount of bromides is the sum of bromides and anions of the dye.

The time for adding water-soluble bromides may be any time after the formation of the silver halide grains, and it is preferably after the finish of their chemical sensitization.

Other sensitizing dyes may also be used in combination with the sensitizing dyes of formula (I) of the present invention. For instance, the sensitizing dyes described in U.S. Pat. Nos. 3,703,377, 2,688,545, 3,397,060, 3,615,635, 3,628,964, British Patents 1,242,588, 1,293,862, JP-B-43-4936, JP-B-44-14030, JP-B-43-10773, U.S. Patent 3,416,927, JP-B-43-4930, U.S. Pat. Nos. 3,615,613, 3,615,632, 3,617,295, 3,635,721 can be used.

Various compounds can be added to the photographic emulsions for use in the present invention, for the purpose of preventing a reduction in the sensitivity of the photographic materials during their manufacture, storage or processing or preventing the generation of fog in them. Such compounds include, for example, nitrobenzimidazole, ammonium chloroplatinate, 4-hydroxy-6-methyl-1,3,3a,7-tetrazaindene, 1-phenyl-5-mercaptotetrazole and other heterocyclic compounds, mercury compounds, mercapto compounds and metal salts, which have been known from ancient days. Some examples of suitable compounds are described in K. Mees, *The Theory of the Photographic Process*, (3rd Ed. 1966), pages 344 to 349 and the related references. Other examples include the thiazolium salts described in U.S. Pat. Nos. 2,131,038, 2,694,716; the azaindenes described in U.S. Pat. Nos. 2,886,437, 2,444,605; the urazoles described in U.S. Pat. No. 3,287,135; the sulfocatechols described in U.S. Pat. No. 3,236,652; the oximes described in British Patent 623,448; the mercaptotetrazoles described in U.S. Pat. Nos. 2,403,927, 3,266,897, 3,397,987; nitrons; nitroimidazoles; the polyvalent metal salts described in U.S. Pat. No. 2,839,405; the thiuronium salts described in U.S. Pat. No. 3,220,839; and the salts of palladium, platinum or gold described in U.S. Pat. Nos. 2,566,263, 2,597,915.

Silver halide photographic emulsions for use in the present invention can contain a developing agent such as hydroquinones, catechols, aminophenols, 3-pyrazolidones, ascorbic acid or derivatives thereof, reductones, phenylenediamines, or a combination of several developing agents. Developing agents can be incorporated into silver halide emulsion layers and/or other photographic layers (for example, protective layer, interlayer, filter layer, anti-halation layer, backing layer). Developing agents can be incorporated thereinto as a solution dissolved in a suitable solvent or as a dispersion in accordance with the technology described in U.S. Pat. No. 2,592,368 and French Patent 1,505,778.

A development accelerator, for example, compounds described in U.S. Pat. Nos. 3,288,612, 3,333,959, 3,345,175, 3,708,303, British Patent 1,098,748, German Patents 1,141,531, 1,183,784, can be used.

Photographic emulsions for use in the present invention can contain an inorganic or organic hardening agent. Examples of the hardening agent include chromium salts (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-traiazine, bis(vinylsulfonyl)methyl ether, N,N'-methylenebis-[β-(vinylsulfonyl)propionamido]), active halogen compounds (e.g., 2,4-dichloro-6-hydroxy-s-triazine), mucohalogenic acids (e.g., mucochloric acid, mucophenoxychloric acid), isoxazoles, dialdehyde starch, and 2-chloro-6-hydroxytriazinylated gelatin. These can be used singly or in combination of two or more. Specific examples of the compounds are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, 3,543,292, British Patents 676,628, 826,544, 1,270,578, German Patents 872,153, 1,090,427, JP-B-34-7133, JP-B-46-1872.

The photographic emulsion layers and other hydrophilic colloid layers constituting the photographic materials of the present invention may contain various surfactants for various purposes, for instance as a coating aid, to prevent static charges, to improve sliding properties, to improve emulsification or dispersion and to improve photographic characteristics (such as acceleration of developability, elevation of hardness and sensitization).

Examples of suitable surfactants include non-ionic surfactants such as saponins (non-steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), fatty acid esters of polyalcohols, alkyl esters of saccharides; anionic surfactants containing an acidic group such as a carboxyl group, a sulfo group, a phospho group, a sulfate group or a phosphate group, such as alkylcarboxylates, alkylsulfonates, alkylbenzenesulfonates, alkylnaphthalenesulfonates, alkylsulfates, alkylphosphates, N-acyl-N-alkyltaurins, sulfosuccinates, sulfoalkylpolyoxyethylene alkylphenyl ethers, polyoxyethylene alkylphosphate; amphoteric surfactants such as amino acids, aminoalkylsulfonic acids, aminoalkylsulfates or aminoalkylphosphates, alkylbetains, amineoxides; and cationic surfactants such as alkylamine salts, aliphatic or aromatic quaternary ammonium salts, heterocyclic quaternary ammonium salts (e.g., pyridinium or imidazolium salts), and aliphatic or heterocyclic phosphonium or sulfonium salts.

For the purpose of improving the sharpness of the toe of the characteristic curve and of obtaining halftone dot images or line images with a high quality, one may use polyalkylene oxide compounds (for example, condensates of polyalkylene oxides comprising at least 10 units of alkylene oxides each having from 2 to 4 carbon atoms, such as ethylene oxide, propylene-1,2-oxide, butylene-1,2-oxide, preferably ethylene oxide, and compounds having at least one active hydrogen atom, such as water, aliphatic alcohols, aromatic alcohols, fatty acids, organic amines or hexitol derivatives; or block copolymers composed of two or more different polyalkylene oxides). Examples of such compounds include the polyalkylene oxide compounds described in JP-A-50-156423, JP-A-52-108130 and JP-A-53-3217. Such polyalkylene oxide compounds can be used singly or in combination of two or more.

As a binder or protective colloid for the photographic emulsions of the present invention, gelatin is advantageously used, but any other hydrophilic colloids may also be used. For instance, one may use proteins such as gelatin derivatives, graft polymers of gelatin and other polymers, albumin, casein; cellulose derivatives such as hydroxyethyl cellulose, carboxymethyl cellulose cellulose sulfates, and saccharide derivatives such as sodium alginate, starch derivatives; as well as other synthetic hydrophilic polymer substances of homopolymers or copolymers, such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole.

The gelatin may be not only a lime-processed gelatin but also an acid-processed gelatin. In addition, hydrolyzates of gelatin or enzyme-decomposed products of gelatin may be used. Suitable gelatin derivatives include those obtained by reacting gelatin and various compounds such as acid halides, acid anhydrides, isocyanates, bromoacetic acid, alkanesultones, vinylsulfonamides, maleimide compounds, polyalkylene oxides or epoxy compounds. Examples are described in U.S. Pat. Nos. 2,614,928, 3,132,945, 3,186,846, 3,312,553, British Patent 861,414, 1,033,189, 1,005,784, and JP-B-42-26845.

The photographic emulsions of the present invention can contain a dispersion of water-insoluble or sparingly water-soluble synthetic polymers, for the purpose of improving the dimensional stability of the photographic materials. For instance, one may use polymers composed of single or mixed monomers of alkyl (meth)acrylates, alkoxyacryl (meth)acrylates, glycidyl (meth)acrylates, (meth)acrylamides, vinyl esters (e.g., vinyl acetate), acrylonitrile, olefins and/or styrene, and optionally other comonomers of acrylic acid, methacrylic acid, α,β-unsaturated dicarboxylic acids, hydroxyalkyl (meth)acrylates, sulfoalkyl (meth)acrylates and/or styrenesulfonic acid.

Any photographic developing method may be applied to the photographic materials of the present invention. Suitable developing agents to be used in developers for developing the materials include dihydroxybenzene developing agents, 1-phenyl-3-pyrazolidone developing agents-and p-aminophenol developing agents. These may be used singly or in combination thereof. For instance, a combination of 1-phenyl-3-pyraozlidones and dihydroxybenzenes or a combination of p-aminophenols and dihydroxybenzenes can be employed. If desired, the photographic materials of the present invention may also be processed with an infectious developer containing a sulfite ion buffer (e.g., carbonyl bisulfite) and hydroquinone.

Suitable dihydroxybenzene developing agents include hydroquinone, chlorohydroquinone, bromohydroquinone, isopropylhydroquinone, toluhydrohydroquinone, methylhydroquinone, 2,3-dichlorohydroquinone, 2,5-dimethylhydroquinone; suitable 1-phenyl-3-pyrazolidone developing agents include 1-phenyl-3-pyrazolidone, 4,4-dimethyl-1-phenyl-3-pyrazolidone, 4-hydroxymethyl-4-methyl-1-phenyl-3-pyraozlidone, 4,4-dihydroxymethyl-1-phenyl-3-pyrazolidonene; and suitable p-aminophenol developing agents include p-aminophenol and N-methyl-p-aminophenol.

The developer for use in the invention can contain, as a preservative, compounds of giving free sulfite ions, such as sodium sulfite, potassium sulfite, potassium metabisulfite or sodium bisulfite. If an infectious developer is used, it may contain formaldehydesodium bisulfite which gives almost no free sulfite ion.

The alkali agents in the developer for use in the present invention include, for example, potassium hydroxide, sodium hydroxide, potassium carbonate, sodium carbonate, sodium acetate, potassium tertiary phosphate, diethanolamine and triethanolamine. The developer generally has a pH value of 9 or more, preferably 9.7 or more.

The developer may contain organic compounds known as antifoggants or development inhibitors. Examples of such compounds include azoles such as benzothiazolium salts, nitroindazoles, nitrobenzimidazoles, chlorobenzimidazoles, bromobenzimidazoles, mercaptotetrazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole); mercaptopyrimidines; mercaptotriazines; thioketo compounds such as oxazolinethione; azaindenes such as triazaindenes, tetrazaindenes (especially, 4-hydroxy-substituted (1,3,3a,7)tetrazaindenes), pentaazaindenes; and benzenethiosulfonic acids, benzenesulfinic acids, benzenesulfonic acid amides, and sodium 2-mercaptobenzimidazole-5-sulfonate.

The developer for use in the present invention can contain the above-mentioned polyalkylene oxides as a development inhibitor. For instance, polyethylene oxides having a molecular weight of from 1000 to 10000 can be incorporated therein in an amount of from 0.1 to 10 g/liter.

The developer for use in the present invention preferably contains, as a hard water softener, nitrilotriacetic acid, ethylenediaminetetraacetic acid, triethylenetetraminehexaacetic acid or diethylenetetraminepentaacetic acid.

Any conventional fixer for processing the photographic materials of the present invention can be used. Suitable fixing agents include thiosulfates and thiocyanates as well as other organic sulfur compounds known to have an effect as a fixing agent.

The fixer for use in the present invention can contain, as a hardening agent, a water-soluble aluminium salt.

The processing temperature and time for processing the photographic material of the present invention may be defined. In general, the processing temperature is suitably from 18° C. to 50° C. Rapid processing with an automatic developing machine is recommended to have a processing time of from 15 to 200 seconds.

Also, the silver halide photographic material of the present invention is preferably processed at a period of 60 seconds or less from the start of development to the finish of drying and/or preferably processed at a linear speed (i.e., feeding speed) of 1200 mm/min or more, with the automatic developing machine, etc.

The present invention will be explained in more detail by way of the following examples, which, however, are not intended to restrict the scope of the present invention.

EXAMPLE 1

An aqueous solution of silver nitrate and an aqueous solution of potassium bromide and sodium chloride were simultaneously added to an aqueous solution of gelatin kept at 50° C., in the presence of $4\times10^{-7}$ mol, per mol of Ag, of potassium iridium(III) hexachloride and $6\times10^{-7}$ mol, per mol of Ag, of rhodium chloride, over a period of 32 minutes to prepare a silver chlorobromide emulsion having a mean grain size of 0.3 μm and a chloride content of 65 mol %. The emulsion was washed with water by an ordinary method to remove soluble salts therefrom, and thereafter gelatin was added thereto.

Subsequently, an aqueous solution of sodium thiosulfate and potassium chloroaurate was added thereto at 65° C. for chemical sensitization to obtain a sensitized emulsion. For comparison, an AgBri emulsion (I content: 2 mol %) having a mean grain size of 0.3 μm was prepared. To each of them was added a dye as indicated in Table 1 below at 65° C. in such a way that the dye-coated percentage of the surfaces of the silver halide grains in the emulsion was 100%.

In the emulsion preparation process, methanol was added to the emulsion in a total amount as shown in Table 1.

To the emulsion to which the dye was added in the above manner, were added 90 mg/m$^2$ of 2-bis(vinylsulfonylacetamido)ethane as a hardening agent, and 20% based on the gelatin binder of polyethyl acrylate latex as a plasticizer. The resulting emulsion was then coated on a polyester film base. The amount of silver in the emulsion coated was 3.5 g/m$^2$ and the amount of gelatin coated was 1.9 g/m$^2$.

Above the emulsion layer, was coated a protective layer comprising 0.8 g/m$^2$ of gelatin, a mat agent containing 40 mg/m$^2$ of polymethyl methacrylate having a mean grain size of 3.0 μm, 10 mg/m$^2$ of colloidal silica having a mean grain size of 3.5 μm and 60 mg/m$^2$ of silicone oil, and a coating aid containing 90 mg/m$^2$ of sodium dodecylbenzenesulfonate, 2 mg/m$^2$ of $C_8F_{17}SO_2N(C_3H_7)$—$CH_2COOK$ and 120 mg/m$^2$ of polyethyl acrylate latex.

The silver halide photographic material is processed with an automatic developing machine over a period of 60 seconds or less as the time from the beginning of development to the finish of drying and further in a feeding rate (i.e., a linear velocity) of 1200 mm/min or more.

The sample thus-obtained was exposed by scanning exposure, using a semiconductor laser capable of emitting a ray of 780 nm. Then, the thus-exposed sample was sensitometrically processed at 38° C. for 14 seconds for development, fixation, rising and drying, by the use of an automatic developing machine (manufactured by Fuji Photo Film Co.).

The absorbance (Abs) at the peak wavelength and the absorbance at the wavelength shorter than the peak by 100 nm were measured using an integrating sphere-combined spectrophotometer (for example, Spectrophotometer U-3410 Model, manufactured by Hitachi, Ltd.), in the manner described above.

The sensitivity (reciprocal of the amount of exposure giving a density of 3.0, as relative sensitivity) and fog value of each sample are shown in Table 1 below.

Evaluation of the residual color, if any, of the processed samples was evaluated with the naked eye to give three ranks of A (very little coloring or none), B (some colored), C (noticeably colored).

| Composition of Developer: | |
|---|---|
| Water | 720 ml |
| Disodium Ethylenediaminetetraacetate | 4 g |
| Sodium Hydroxide | 44 g |
| Sodium Sulfite | 45 g |
| 2-Methylimidazole | 2 g |
| Sodium Carbonate | 26.4 g |
| Boric Acid | 1.6 g |
| Potassium Bromide | 1 g |
| Hydroquinone | 36 g |
| Diethylene Glycol | 39 g |
| 5-Methylbenzotriazole | 0.2 g |
| Pyrazole | 0.7 g |
| Water to make | 1 liter |
| Composition of Fixer: | |
| Ammonium Thiosulfate | 170 g |
| Sodium Sulfite (anhydride) | 15 g |
| Boric Acid | 7 g |
| Glacial Acetic Acid | 15 ml |
| Potassium Alum | 20 g |
| Ethylenediaminetetraacetic Acid | 0.1 g |
| Tartaric Acid | 3.5 g |
| Water to make | 1 liter |

TABLE 1

| No. | Dye No. | Amount of Methanol (mg/kg of emulsion) | Emulsion | Abs(peak)/Abs (peak - 100 nm) | Sensitivity | Fog | Residual Color | Remarks |
|---|---|---|---|---|---|---|---|---|
| 1 | I-2 | — | AgClBr | 7.2 | 100 (standard) | 0.06 | A | Invention |
| 2 | I-2 | 50 | AgClBr | 6.2 | 89 | 0.07 | A | Invention |
| 3 | I-2 | 200 | AgClBr | 3.5 | 63 | 0.08 | A | Comparison |
| 4 | I-3 | — | AgClBr | 8.1 | 100 (standard) | 0.06 | A | Invention |
| 5 | I-3 | 50 | AgClBr | 7.0 | 91 | 0.06 | A | Invention |
| 6 | I-3 | 200 | AgClBr | 3.9 | 69 | 0.07 | A | Comparison |
| 7 | 1-5 | — | AgClBr | 6.8 | 100 (standard) | 0.06 | A | Invention |
| 8 | I-5 | 50 | AgClBr | 6.1 | 93 | 0.06 | A | Invention |
| 9 | I-5 | 200 | AgClBr | 3.6 | 65 | 0.07 | A | Comparison |
| 10 | I-9 | — | AgClBr | 7.7 | 100 (standard) | 0.06 | A | Invention |
| 11 | 1-9 | 50 | AgClBr | 4.2 | 69 | 0.07 | A | Comparison |
| 12 | I-9 | 200 | AgClBr | 2.1 | 56 | 0.08 | A | Comparison |
| 13 | I-16 | — | AgClBr | 7.2 | 100 (standard) | 0.06 | A | Invention |
| 14 | I-16 | 50 | AgClBr | 4.6 | 71 | 0.07 | A | Comparison |
| 15 | I-16 | 200 | AgClBr | 3.1 | 62 | 0.07 | A | Comparison |
| 16 | I-20 | — | AgClBr | 6.6 | 100 (standard) | 0.06 | A | Invention |
| 17 | I-21 | — | AgClBr | 7.1 | 87 | 0.06 | A | Invention |
| 18 | I-24 | — | AgClBr | 6.8 | 81 | 0.06 | A | Invention |
| 19 | I-2 | — | AgBrI | 5.3 | 100 (standard) | 0.07 | B | Invention |
| 20 | I-2 | 50 | AgBrI | 3.1 | 66 | 0.08 | C | Comparison |
| 21 | I-3 | — | AgBrI | 5.4 | 100 (standard) | 0.07 | B | Invention |
| 22 | I-3 | 50 | AgBrI | 2.8 | 63 | 0.08 | B | Comparison |
| 23 | II-1 | — | AgClBr | 5.9 | 100 (standard) | 0.07 | B | Invention |
| 24 | II-1 | 200 | AgClBr | 3.0 | 58 | 0.08 | C | Comparison |
| 25 | II-4 | — | AgClBr | 6.1 | 100 (standard) | 0.07 | B | Invention |
| 26 | II-4 | 200 | AgClBr | 2.7 | 55 | 0.08 | C | Comparison |
| 27 | II-6 | — | AgClBr | 6.2 | 100 (standard) | 0.07 | B | Invention |
| 28 | II-6 | 200 | AgClBr | 2.3 | 53 | 0.08 | B | Comparison |
| 29 | II-8 | — | AgClBr | 6.2 | 100 (standard) | 0.07 | B | Invention |
| 30 | II-8 | 200 | AgClBr | 2.4 | 56 | 0.08 | C | Comparison |
| 31 | II-13 | — | AgClBr | 5.8 | 100 (standard) | 0.07 | B | Invention |
| 32 | II-13 | 200 | AgClBr | 3.1 | 62 | 0.08 | B | Comparison |

As is apparent from the results in Table 1 above, it is understood that the sensitizing system of satisfying the condition of equation (1) of the present invention is highly sensitive and causes little fog.

While the invention has been described in detail and with reference to specific embodiments thereof, it will be apparent to one skilled in the art that various changes and modifications can be made therein without departing from the spirit and scope thereof.

What is claimed is:

1. A black and white silver halide photographic material comprising a support having thereon at least one silver halide photographic emulsion layer, wherein said silver halide emulsion layer has been spectral-sensitized with at least one spectral-sensitizer to have a sensitized peak in a wavelength range greater than 730 nm; absorbance of light due to said silver halide emulsion containing said spectral-sensitizer satisfies the following equation:

$$\text{Abs (peak wavelength)/Abs (peak wavelength}-100\text{ nm)}>5;$$

and said spectral-sensitizer comprises at least one imidadicarbocyanine dye.

2. The black and white silver halide photographic material as in claim 1, wherein the silver halide emulsion comprises a silver halide having a chloride content of 50 mol % or more.

3. The black and white silver halide photographic material as in claim 1, wherein said at least one spectral-sensitizer is represented by formula (I):

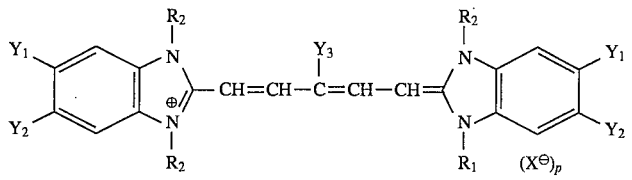

(I)

wherein $R_1$ and $R_2$ each represents an alkyl group having from 1 to 8 carbon atoms;

$Y_1$ and $Y_2$ are bonded to each other to form an atomic group for completing a benzene nucleus, or each represent a hydrogen atom, a halogen atom, a cyano group or a perfluoroalkyl group;

$Y_3$ represents a hydrogen atom, an alkyl group having from 1 to 4 carbon atoms, a benzyl group or a phenyl group;

X represents an anion;

p represents a number to be determined so that the number of cation charges and the number of anion charges in the formula are the same; and X may be bonded to $R_1$ or $R_2$ to form an internal salt.

4. The black and white silver halide photographic material as in claim 1, wherein said silver halide emulsion contains an organic solvent in an amount of 180 ml or less per kg of the emulsion.

5. The black and white silver halide photographic material as in claim 4, wherein said organic solvent is selected from the group consisting of methanol and ethanol.

6. The black and white silver halide photographic material as in claim 1, wherein said silver halide emulsion comprises silver halide grains having a dye-coated percentage of 50% or more based on the surfaces thereof.

* * * * *